US008956081B2

(12) United States Patent
Noble et al.

(10) Patent No.: US 8,956,081 B2
(45) Date of Patent: Feb. 17, 2015

(54) ICE WORTHY JACK-UP DRILLING UNIT WITH GAS AGITATED ICE PREVENTION

(75) Inventors: Peter G. Noble, Spring, TX (US); Randall S. Shafer, Houston, TX (US); Dominique P. Berta, Katy, TX (US)

(73) Assignee: ConocoPhillips Company, Houston, TX (US)

( * ) Notice: Subject to any disclaimer, the term of this patent is extended or adjusted under 35 U.S.C. 154(b) by 275 days.

(21) Appl. No.: 13/279,062

(22) Filed: Oct. 21, 2011

(65) Prior Publication Data

US 2012/0128431 A1 May 24, 2012

Related U.S. Application Data

(63) Continuation-in-part of application No. 13/277,791, filed on Oct. 20, 2011.

(60) Provisional application No. 61/405,497, filed on Oct. 21, 2010.

(51) Int. Cl.

| | |
|---|---|
| ***E02B 17/00*** | (2006.01) |
| ***E02B 1/00*** | (2006.01) |
| ***E02B 17/02*** | (2006.01) |
| ***E21B 7/00*** | (2006.01) |

(52) U.S. Cl.

CPC ..... *E02B 17/0021* (2013.01); *E02B 1/003* (2013.01); *E02B 17/021* (2013.01); *E21B 7/008* (2013.01); *B63B 2211/06* (2013.01); *E02B 2017/0039* (2013.01); *E02B 2017/006* (2013.01); *E02B 2017/0082* (2013.01)

USPC ..... 405/217; 405/196; 405/203; 405/211

(58) Field of Classification Search

USPC ..... 405/196–199, 203, 211, 217, 224

See application file for complete search history.

(56) References Cited

U.S. PATENT DOCUMENTS

| | | | | |
|---|---|---|---|---|
| 4,102,144 | A * | 7/1978 | Anders | 405/211 |
| 4,578,000 | A * | 3/1986 | Lindqvist et al. | 405/211 |
| 2008/0237173 | A1 * | 10/2008 | Altman et al. | 212/347 |

* cited by examiner

*Primary Examiner* — Tara M. Pinnock

(74) *Attorney, Agent, or Firm* — ConocoPhillips Company

(57) ABSTRACT

An ice worthy jack-up rig that may extend the drilling season in shallow water off shore Arctic or ice prone locations. The rig would work like a conventional jack-up rig while in open water with the hull jacked up out of the water. However, in the event of ice conditions, the legs are held in place by cans embedded in the sea floor to resist lateral movement of the rig and the hull is lowered into the water into an ice defensive configuration. The hull is specifically shaped with an ice-bending surface to bend and break up ice that comes in contact with the hull while in the ice defensive configuration.

6 Claims, 4 Drawing Sheets

ICE WORTHY JACK-UP DRILLING UNIT WITH GAS AGITATED ICE PREVENTION

CROSS-REFERENCE TO RELATED APPLICATIONS

This application is a non-provisional application which claims benefit under 35 USC §119(e) to U.S. Provisional Application Ser. No. 61/405,497 filed Oct. 21, 2010, entitled "Ice Worthy Jack-Up Drilling Unit," and is a continuation-in-part application which claims benefit under 35 USC §120 to U.S. application Ser. No. 13/277,791 filed Oct. 20, 2011, entitled "Ice Worthy Jack-Up Drilling Unit" both of which are incorporated herein in their entirety.

STATEMENT REGARDING FEDERALLY SPONSORED RESEARCH OR DEVELOPMENT

None.

FIELD OF THE INVENTION

This invention relates to mobile offshore drilling units, often called "jack-up" drilling units or rigs that are used in shallow water, typically less than 400 feet, for drilling for hydrocarbons.

BACKGROUND OF THE INVENTION

In the never-ending search for hydrocarbons, many oil and gas reservoirs have been discovered over the last one hundred and fifty years. Many technologies have been developed to find new reservoirs and resources and most areas of the world have been scoured looking for new discoveries. Few expect that any large, undiscovered resources remain to be found near populated areas and in places that would be easily accessed. Instead, new large reserves are being found in more challenging and difficult to reach areas.

One promising area is in the offshore Arctic. However, the Arctic is remote and cold where ice on the water creates considerable challenges for prospecting for and producing hydrocarbons. Over the years, it has generally been regarded that six unprofitable wells must be drilled for every profitable well. If this is actually true, one must hope that the unprofitable wells will not be expensive to drill. However, in the Arctic, little, if anything, is inexpensive.

Currently, in the shallow waters of cold weather places like the Arctic, a jack-up or mobile offshore drilling unit (MODU) can be used for about 45-90 days in the short, open-water summer season. Predicting when the drilling season starts and ends is a game of chance and many efforts are undertaken to determine when the jack-up may be safely towed to the drilling location and drilling may be started. Once started, there is considerable urgency to complete the well to avoid having to disconnect and retreat in the event of ice incursion before the well is complete. Even during the few weeks of open water, ice floes present a significant hazard to jack-up drilling rigs where the drilling rig is on location and legs of the jack-up drilling rig are exposed and quite vulnerable to damage.

Jack-up rigs are mobile, self-elevating, offshore drilling and workover platforms equipped with legs that are arranged to be lowered to the sea floor and then to lift the hull out of the water. Jack-up rigs typically include the drilling and/or workover equipment, leg jacking system, crew quarters, loading and unloading facilities, storage areas for bulk and liquid materials, helicopter landing deck and other related facilities and equipment.

A jack-up rig is designed to be towed to the drilling site and jacked-up out of the water so that the wave action of the sea only impacts the legs which have a fairly small cross section and thus allows the wave action to pass by without imparting significant movement to the jack-up rig. However, the legs of a jack-up provide little defense against ice floe collisions and an ice floe of any notable size is capable of causing structural damage to one or more legs and/or pushing the rig off location. If this type of event were to happen before the drilling operations were suspended and suitable secure and abandon had been completed, a hydrocarbon leak would possibly occur. Even a small risk of such a leak is completely unacceptable in the oil and gas industry, to the regulators and to the public.

Thus, once it is determined that a potentially profitable well has been drilled during this short season, a very large, gravity based production system, or similar structure may be brought in and set on the sea floor for the long process of drilling and producing the hydrocarbons. These gravity based structures are very large and very expensive, but are built to withstand the ice forces year around.

BRIEF SUMMARY OF THE DISCLOSURE

The invention more particularly relates to an ice worthy jack up rig for drilling for hydrocarbons in potential ice conditions in offshore areas including a flotation hull having a relatively flat deck at the upper portion thereof. The flotation hull further includes an ice bending shape along the lower portion thereof and extending around the periphery of the hull where the ice bending shape extends from an area of the hull near the level of the deck and extends downwardly near the bottom of the hull along with an ice deflecting portion extending around the perimeter of the bottom of the hull to direct ice around the hull and not under the hull. The rig includes at least three legs that are positioned within the perimeter of the bottom of the hull wherein the legs are arranged to be lifted up off the seafloor so that the rig may be towed through shallow water and also extend to the sea floor and extend further to lift the hull partially or fully out of the water. A jack up device is associated with each leg to both lift the leg from the sea bottom so that the ice worthy jack up rig may float by the buoyancy of the hull and push the legs down to the seafloor and push the hull partially up and out of the water when ice floes threaten the rig and fully out of the water when ice is not present. A gas agitation system is provided to agitate the water near the legs and reduce issues with ice near the legs.

The invention further relates to a method for drilling wells in ice prone waters. The method includes providing a flotation hull having a relatively flat deck at the upper portion thereof and an ice bending shape along the lower portion thereof where the ice bending shape extends from an area of the hull near the level of the deck and extends downwardly near the bottom of the hull and an ice deflecting portion extending around the perimeter of the bottom of the hull to direct ice around the hull and not under the hull. At least three legs are positioned within the perimeter of the bottom of the hull. Each leg is jacked down in a manner that feet on the bottom of the legs engages the sea floor and lifts the hull up and fully out of the water when ice is not threatening the rig while the rig is drilling a well on a drill site. The hull is further lowered into the water into an ice defensive configuration so that the ice bending shape extends above and below the sea surface to bend ice that comes against the rig to cause the ice to submerge under the water and endure bending forces that break the ice where the ice flows past the rig. The method further includes agitating the water near the legs to reduce issues with ice near the legs.

BRIEF DESCRIPTION OF THE DRAWINGS

A more complete understanding of the present invention and benefits thereof may be acquired by referring to the follow description taken in conjunction with the accompanying drawings in which.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

Figure 1:
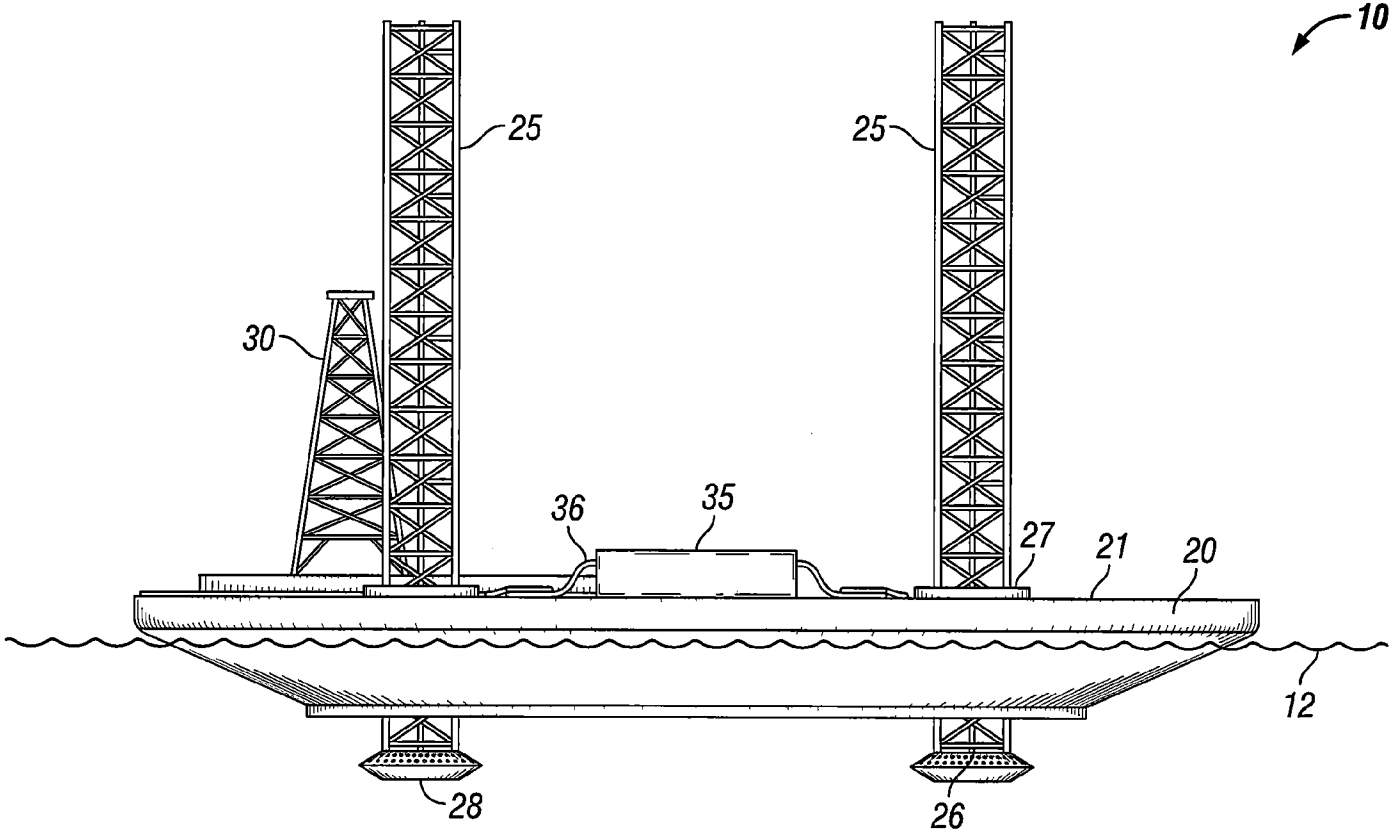
FIG. 1 is an elevation view of a first embodiment of the present invention where the drilling rig is floating in the water and available to be towed to a well drilling site.

As shown in FIG. 1, an ice worthy jack-up rig is generally indicated by the arrow 10. In FIG. 1, jack-up rig 10 is shown with its hull 20 floating in the sea and legs 25 in a lifted arrangement where much of the length of the legs 25 extend above the deck 21 of the hull 20. On the deck 21 is derrick 30 which is used to drill wells. In the configuration shown in FIG. 1, the jack-up rig 10 may be towed from one prospect field to another and to and from shore bases for maintenance and other shore service.

Figure 2:
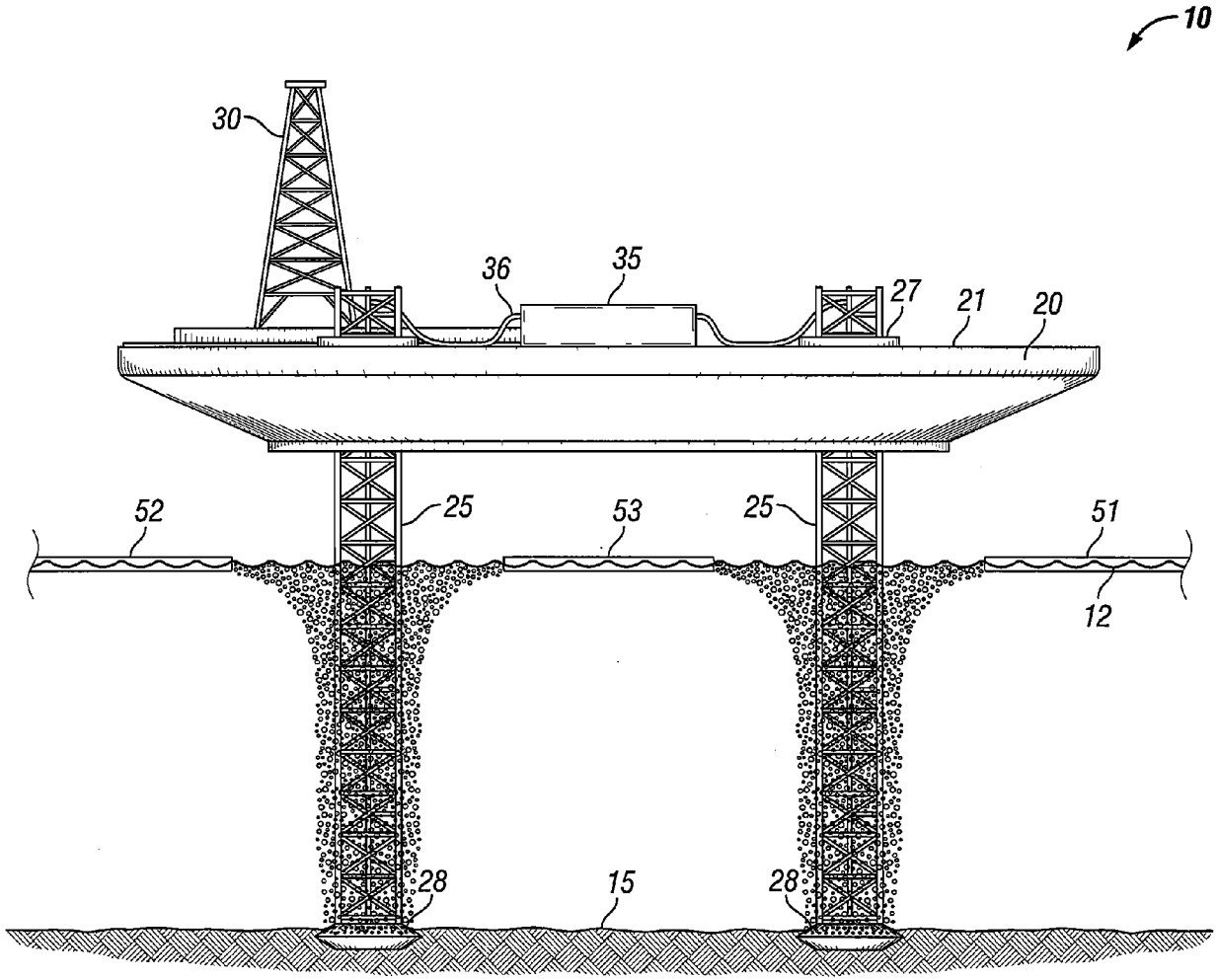
FIG. 2 is an elevation view of the first embodiment of the present invention where the drilling rig is jacked up out of the water for open water drilling through a moon pool.
Figure 3:
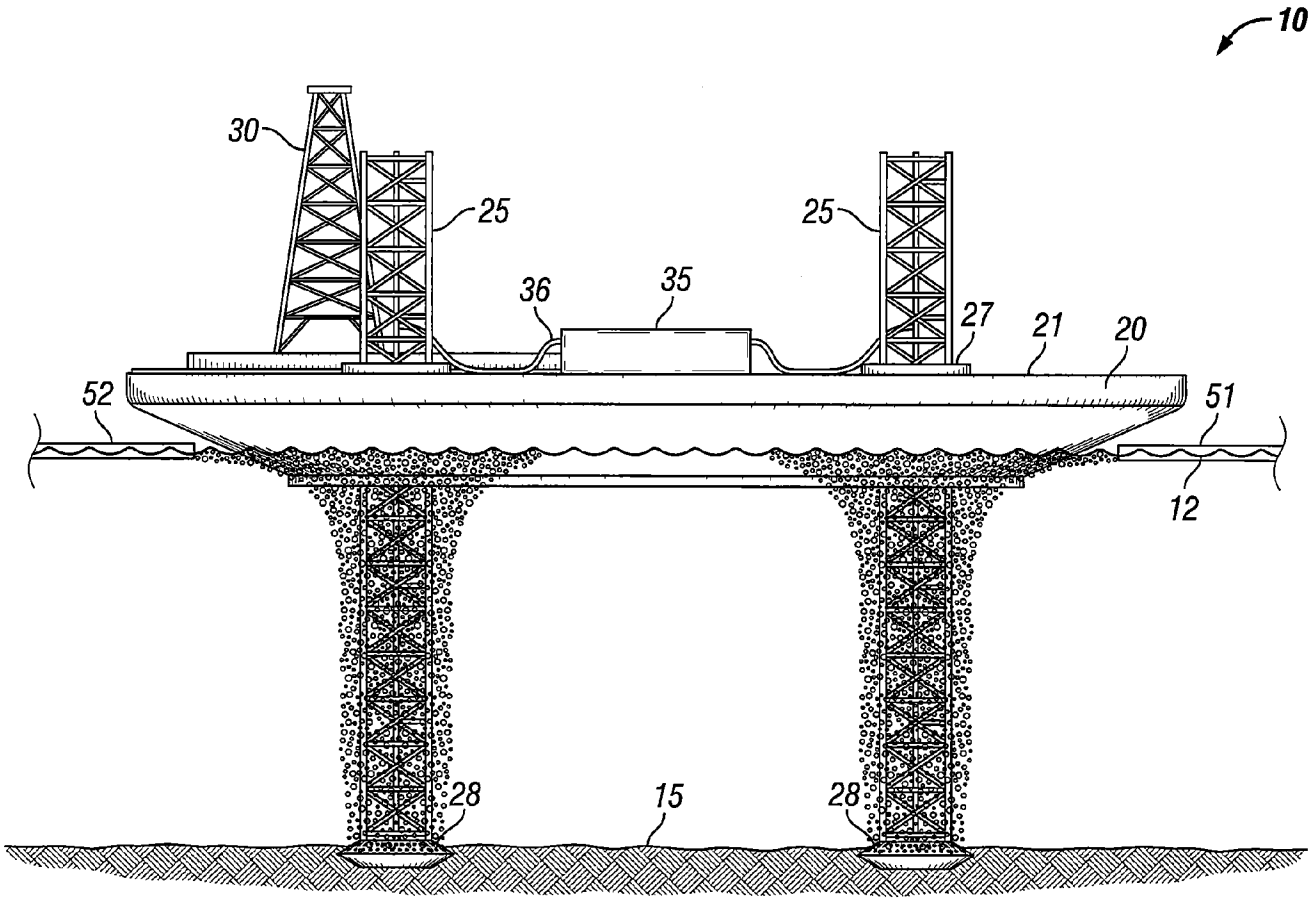
FIG. 3 is an elevation view of the first embodiment of the present invention where the drilling rig is partially lowered into the ice/water interface, but still supported by its legs, in a defensive configuration for drilling during potential ice conditions.

When the jack-up rig 10 is towed to a drilling site in generally shallow water, the legs 25 are lowered through the openings 27 in hull 20 until the feet 26 at the bottom ends of the legs 25 engage the seafloor 15 as shown in FIG. 2. In a preferred embodiment, the feet 26 are connected to spud cans 28 to secure the rig 10 to the seafloor. Once the feet 26 engage the seafloor 15, jacking rigs within openings 27 push the legs 25 down and therefore, the hull 20 is lifted out of the water. With the hull 20 fully jacked-up and out of the water, any wave action and heavy seas more easily break past the legs 25 as compared to the effect of waves against a large buoyant object like the hull 20. Well drilling operations may commence in the ordinary course while there is no ice in the area. The ice-worthy jack-up drilling rig 10 is designed to resist ice floes by assuming an ice defensive, hull-in-water configuration as shown in FIG. 3. In FIG. 3, ice tends to dampen waves and rough seas, so the sea surface 12 appears less threatening, however, the hazards of the marine environment have only altered, and not lessened.

When the ice-worthy jack-up rig 10 assumes its ice defensive, hull-in-water configuration, the hull 20 is lowered into the water to contact same, but not to the extent that the hull 20 would begin to float. A significant portion of the weight of the rig 10 preferably remains on the legs 25 to hold the position of the rig 10 on the drill site against any pressure an ice flow might bring. The rig 10 is lowered so that inwardly sloped, ice-bending surface 41 bridges the sea surface 12 or ice/water interface to engage any floating ice that may come upon the rig 10.

The sloped ice-bending surface 41 runs from shoulder 42, which is at the edge of the deck 26, down to neckline 44. Ice deflector 45 extends downward from neckline 44. Thus, when an ice floe, such as shown at 51 comes to the rig 10, the ice-bending surface 41 causes the leading edge of the ice floe 51 to submerge under the sea surface 12 and apply a significant bending force that breaks large ice floes into smaller, less damaging, less hazardous bits of ice. For example, it is conceivable that an ice floe being hundreds of feet and maybe miles across could come toward the rig 10. If the ice floe is broken into bits that are less than twenty feet in the longest dimension, such bits are able to pass around the rig 10 with much less concern.

Figure 4:
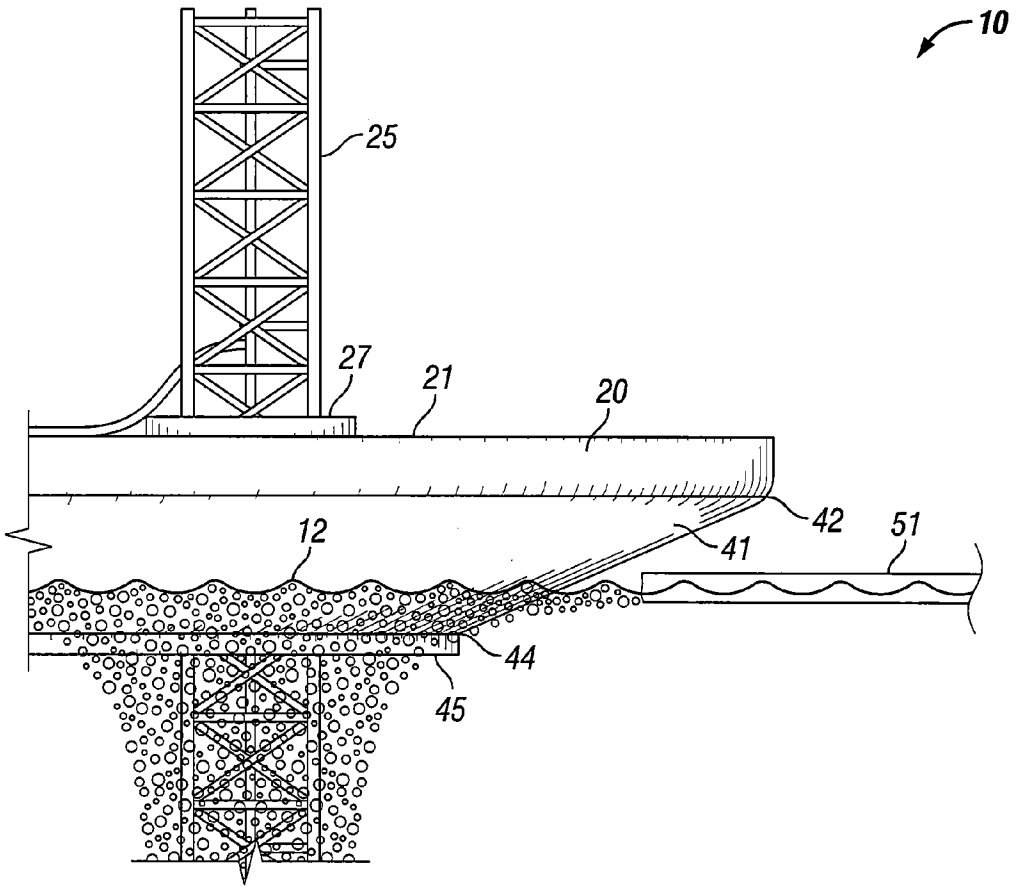
FIG. 4 is an enlarged fragmentary elevation view showing one end of the first embodiment of the present invention in the FIG. 3 configuration with ice moving against the rig.

In FIGS. 2, 3 and 4, the present invention offers an additional ice defensive aspect where air blower 35 is arranged to blow air down through hoses to the spud cans 28. The spud cans 28 include holes or diffusers to release air bubbles to agitate the water around the legs 25. The agitated water is stirred to prevent ice from forming on the legs and creates a natural flow away from the legs. With the gas agitation system, it may be practical to maintain the rig 10 in the configuration shown in FIG. 2 when ice first becomes a concern rather than immediately begin the involved process of transitioning the rig 10 from the configuration shown in FIG. 2 to the defensive, hull-in-water configuration shown in FIG. 3. This may be helpful if weather forecasts suggest possible ice conditions for a period of time followed by storms and heavy seas (in which the out of the water configuration shown in FIG. 2 is preferred).

Ice has substantial compressive strength being in the range of 4 to 12 MPa, but is much weaker against bending with typical flexure strength in the range of 0.3 to 0.5 MPa. As shown, the force of the ice floe 51 moving along the sea surface 12 causes the leading edge to slide under the sea surface 12 and caused section 52 to break off. With the ice floe 51 broken into smaller floes, such as section 52 and bit 53, the smaller sections tend to float past and around the rig 10 without applying the impacts or forces of a large floe. It is preferred that ice not be forced under the flat of bottom of the hull 20 and the ice deflector 45 turns ice to flow around the side of the hull 20. If the ice is really thick, the ice deflector 45 is arranged to extend downwardly at a steeper angle than ice-bending surface 41 and will increase the bending forces on the ice floe. At the ice deflector 45, an ice deflector is positioned to extend down from the flat of bottom of the hull 20. In an optional arrangement, the turn of the bilge is the flat of bottom at the bottom end of the ice deflector 45.

To additionally resist the forces that an ice floe may impose on the rig 10, the feet 26 of the legs may be arranged to connect to cans 28 set in the sea floor so that when an ice floe comes against the ice-bending surface 41, the legs 25 actually hold the hull 20 down and force the bending of the ice floe and resist the lifting force of the ice floe which, in an extreme case, may lift the near side of the rig 10 and push the rig over on its side by using the feet 26 on the opposite side of the rig 10 as the fulcrum or pivot. The cans in the sea floor are known for other applications and the feet 26 would include appropriate connections to attach and release from the cans, as desired.

It should probably be noted that shifting from a conventional open water drilling configuration as shown in FIG. 2 to a hull-in-water, ice defensive configuration shown in FIG. 3 may require considerable planning and accommodation depending on what aspect of drilling is ongoing at the time. While some equipment can accommodate shifting of the height of the deck 21, other equipment may require disconnections or reconfiguration to adapt to a new height off the sea floor 15.

The ice-worthy jack-up drill rig 10 is designed to operate like a conventional jack-up rig in open water, but is also designed to settle to the water in an ice defensive position and then re-acquire the conventional stance or configuration when wave action becomes a concern. It is the shape of the hull 20 (as well as its strength) that provides ice bending and breaking capabilities.

The hull 20 preferably has a faceted or multisided shape that provides the advantages of a circular or oval shape, and may be less expensive to construct. The plates that make up the hull would likely be formed of flat sheets and so that the entire structure comprises segments of flat material such as steel would likely require less complication. The ice-breaking surface would preferably extend at least about five meters above the water level, recognizing that water levels shift up and down with tides and storms and perhaps other influences. The height above the water level accommodates ice floes that are quite thick or having ridges that extend well above the sea surface 12, but since the height of the shoulder 42 is well above the sea surface 12, the tall ice floes will be forced down as they come into contact with the rig 10. At the same time, the deck 21 at the top of the hull 20 should be far enough above the water line so that waves are not able to wash across the deck. As such, the deck 25 is preferred to be at least 7 to 8 meters above the sea surface 12. Conversely, the neckline 42 is preferred to be at least 4 to 8 meters below the sea surface 12 to adequately bend the ice floes to break them up into more harmless bits. Thus, the hull 20 is preferably in the range of 5-16 meters in height from the flat of bottom to the deck 20, more preferably 8-16 meters or 11-16 meters.

It should also be noted that the legs 25 and the openings 27 through which they are connected to the hull 20 are within the perimeter of the ice deflector 45 so that the ice floes are less likely to contact the legs while the rig 10 is in its defensive ice condition configuration as shown in FIG. 3 and sometimes called hull-in-water configuration. Moreover, the rig 10 does not have to handle every ice floe threat to significantly add value to oil and gas companies. If rig 10 can extend the drilling season by as little as a month, that would be a fifty percent improvement in some ice prone areas and therefore provide a very real cost saving benefit to the industry.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims, while the description, abstract and drawings are not to be used to limit the scope of the invention. The invention is specifically intended to be as broad as the claims below and their equivalents.

The invention claimed is:

1. An ice worthy jack up rig for drilling for hydrocarbons in potential ice conditions in offshore areas comprising:

a flotation hull having a relatively flat deck at the upper portion thereof and an ice bending shape along the lower portion thereof and extending downwardly and inwardly around the periphery of the hull where the ice bending shape extends from an area of the hull near the level of the deck and extends downwardly near the bottom of the hull;

an ice deflecting portion extending around the perimeter of the bottom of the hull to direct ice around the hull and not under the hull;

at least three legs that are positioned within the perimeter of the bottom of the flotation hull wherein the legs are arranged to be lifted up off the seafloor so that the rig may be towed through shallow water and also extend to the sea floor and extend further to lift the hull partially or fully out of the water;

a jack up device associated with each leg to both lift the leg from the sea bottom so that the ice worthy jack up rig may float by the buoyancy of the hull and push the legs down to the seafloor and push the hull partially up and out of the water when ice floes threaten the rig and fully out of the water when ice is not present; and a gas agitation system including holes in seafloor engaging spud cans at bottom ends of the legs for releasing bubbles through the holes to agitate the water near the legs and reduce issues with ice near the legs and prevents ice from forming on the legs.

2. The ice worthy jack up rig according to claim 1, further including an anchoring mechanism associated with a foot of each leg to provide additional resistance to the forces an ice floe may impose on the rig.

3. The ice worthy jack up rig according to claim 1, wherein the ice bending surface is slanted upwardly and outwardly from a smaller dimension neckline to a larger dimension shoulder.

4. The ice worthy jack up rig according to claim 1, wherein the ice bending surface extends vertically at least 8 to 10 or more meters.

5. The ice worthy jack up rig according to claim 4, wherein the angle of the ice bending surface is in the range of 30 to 60 degrees from the vertical.

6. The ice worthy jack up rig according to claim 1, wherein the ice bending surface comprises a plurality of relatively flat, sloped, segments extending around the periphery of the rig.

* * * * *